United States Patent [19]

Goncalves

[11] 4,415,081

[45] Nov. 15, 1983

[54] CARRIER ALBUM CASE

[76] Inventor: Antonio Goncalves, 379 N. 6th St., Newark, N.J. 07107

[21] Appl. No.: 416,215

[22] Filed: Sep. 9, 1982

[51] Int. Cl.[3] ..... B65D 5/50; B65D 85/57; B65D 85/62

[52] U.S. Cl. ..... 206/311; 206/45.11

[58] Field of Search ..... 206/311, 45.11, 45.15, 206/45.24

[56] References Cited

U.S. PATENT DOCUMENTS

| | | | |
|---|---|---|---|
| 1,061,374 | 5/1913 | Harrington | 206/45.11 |
| 1,863,047 | 6/1932 | Grimsley | 206/45.15 |
| 2,463,338 | 3/1949 | Wechsler | 206/45.11 |
| 4,287,986 | 9/1981 | Beck | 206/45.24 |

*Primary Examiner*—William T. Dixson, Jr.

*Attorney, Agent, or Firm*—Howard I. Podell

[57] ABSTRACT

A carrier album case for storing and carrying flat objects such as phonograph records and cassette tapes formed of a flat side panel having foldable upper, lower and outer tabs constituting three walls of the carrier and an inner tab hinged to a cover member terminating in a tab fitting over and fastened to the outer tab when the case is closed. A plurality of plastic envelopes is fixed through their middle to the outer tab near its fold line, with each envelope forming a holder for two flat objects. A similar set of envelopes is mounted on the inner tab near its hinge line with the cover, and handle means are secured to the outside of at least one tab member. Opening the cover member provides accessibility to the envelopes secured to the inner tab while opening the outer tab provides access to the envelopes secured thereto.

9 Claims, 8 Drawing Figures

CARRIER ALBUM CASE

FIELD OF THE INVENTION

This invention relates generally to a carrier for phonograph records and cassettes.

STATEMENT OF THE PRIOR ART

The prior art, as exemplified by U.S. Pat. Nos. 1,330,301; 1,683,479; 1,502,312; 2,463,450; 3,374,041 and 3,826,360 is generally illustrative of various devices of this type. While such devices are usually acceptable for their intended purposes, they have not proven to be entirely satisfactory in that they are either complex and expensive to manufacture, or bulky and inconvenient to use. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character, which combines simplicity, strength, and durability in a high degree, together with inexpensiveness of construction.

Other objects of this invention will in part be obvious and in part hereinafter pointed out.

SUMMARY OF THE INVENTION

This invention resides in a carrier album case for storing and carrying flat objects such as phonograph records and cassette tapes formed of a flat side panel having foldable upper, lower and outer tabs constituting three walls of the carrier and an inner tab hinged to a cover member terminating in a tab fitting over and fastened to the outer tab when the case is closed. A plurality of plastic envelopes is fixed through their middle to the outer tab near its fold line, with each envelope forming a holder for two flat objects. A similar set of envelopes is mounted on the inner tab near its hinge line with the cover, and handle means are secured to the outside of at least one tab member. Opening the cover member provides accessibility to the envelopes secured to the inner tab while opening the outer tab provides access to the envelopes secured thereto.

BRIEF DESCRIPTION OF THE DRAWING

In the accompanying drawing, in which is shown one of the previous possible variations of this invention, and wherein like preference characters identify the same or like parts.

DISCLOSURE OF BEST MODE OF THE INVENTION

Figure 1:
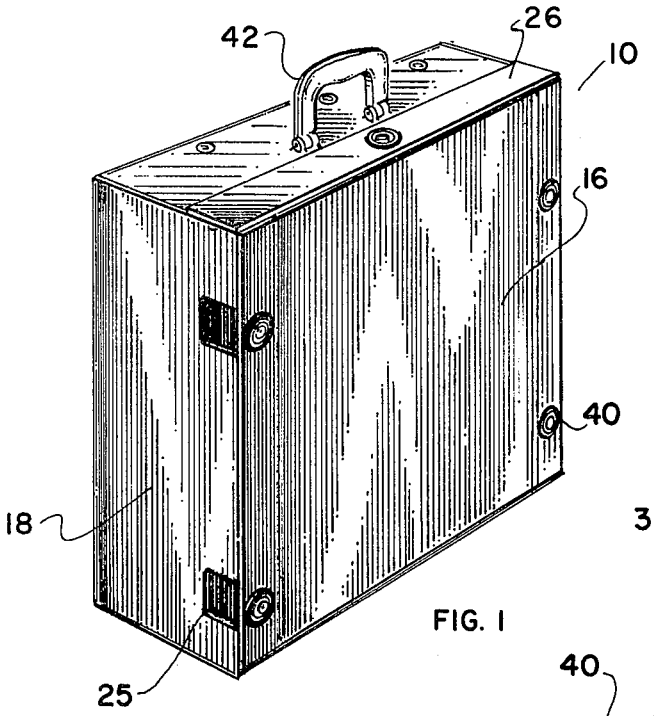
FIG. 1 is a perspective view of a closed carrier case according to this invention.

With reference to the drawing, there is shown and illustrated a carrier case for records constructed in accordance with the principles of the invention and designated by reference character 10. The case 10 is constructed of semi-rigid material such as corrugated cardboard, plastic and the like and contains two sets of double article-holding envelopes with one set mounted to one side of the case and the other set being foldable on the other side when the case is closed.

Case 10 includes a flat, generally rectangular side panel 12 formed along scored fold lines 14 with bottom 16 which has upper and lower foldable tabs 18,20 with end flanges 22,24 foldably connected thereto. Flanges 22,24 have mating fasteners 30,40 on their inner surfaces. Also connected to panel 12 is a foldable end tab 26 which has an integral terminal flange 28 provided with fasteners 30. On its inner side, panel 16 is connected to or integral with central portion 32 which is foldable on panel 16 along line 14. Portion 32 is foldably connected to cover 34 along fold line 36. Cover 34 terminates in closing tab 38 which has fastener 40 on its outer surface adapted to cooperate with fastener 30 on member 26.

A handle 42 is secured to the outside of member 26.

The records 50 to be carried in the case are each housed in a half of an individual envelope 44 with each envelope saked and secured in a suitable way at the middle of the envelope to members 26 or 32 to facilitate folding and unfolding the double envelopes thus formed.

Figure 4:
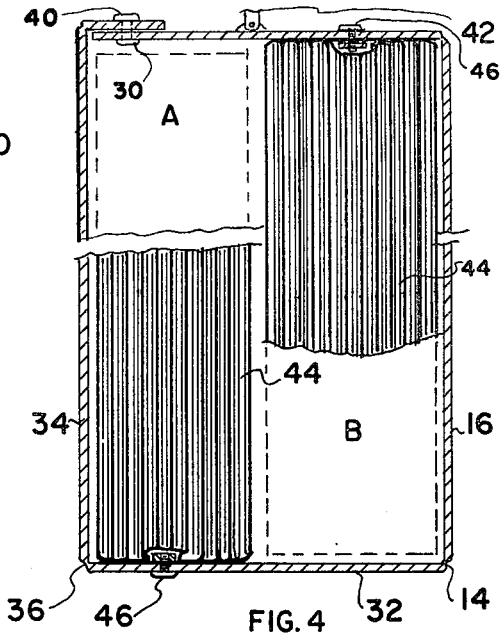
FIG. 4 is a detailed view showing attachment of the envelopes.

As shown in FIG. 4, the envelopes may be secured by means of flat head rivets 46. Alternatively, a hollow internally threaded pin and a screw engaged therein can be passed through openings in the stakes of envelopes to removably secure same to case 10.

Figure 2:
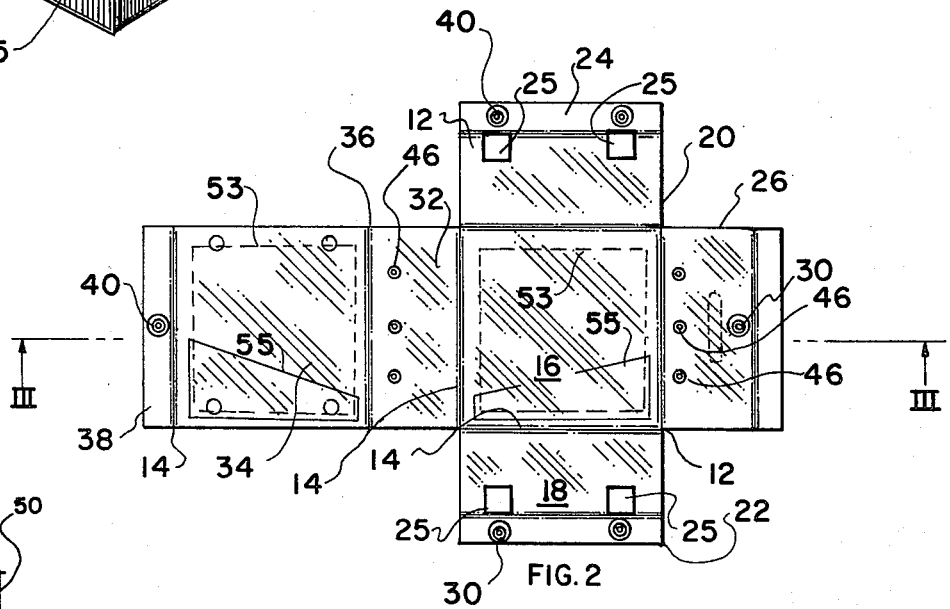
FIG. 2 is a top plan view of the open case without the envelope holders.
Figure 5:
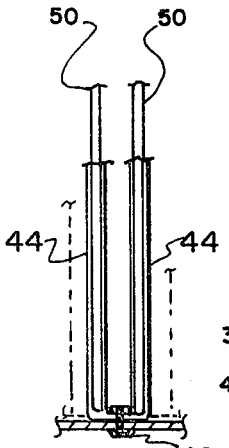
FIG. 5 is a detail section view of FIG. 4.
Figure 3:
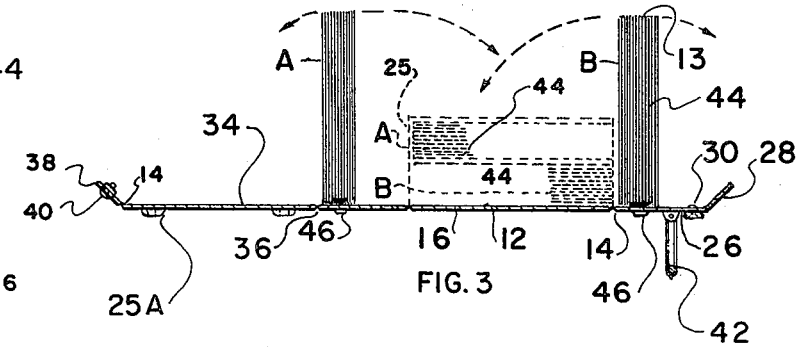
FIG. 3 is a sectional view showing the case in open position and by dashed line in closed position.

The album 10 is shown in the fully open position in FIGS. 2 and 3. The envelope stacks A,B may be folded as shown by the dash lines from the horizontal rest position to the vertical positions shown in FIGS. 3 and 5 as desired for removal or insertion of a record 50 into an envelope 44. Each envelope may be marked with an individual indicia, and a booklet 53 listing the identity and location of each record 50 in the marked envelopes may be stored in an open envelope 55 fixed to the inside cover 34.

In the fully open album position shown in FIG. 3, all envelopes 44 in the vertical position are open to the top.

To close the album 10, members 18 and 20 are rotated into the vertical plane, and member 26 to which album stack B is attached is rotated to the vertical position, causing stack B to rest against cover 16. Member 32 is similarly rotated into the vertical position to cause stack A to rest on top of stack B as shown in dash lines in FIG. 3.

Each tab section 22, 24 are now folded over the stack A and cover 34 is now folded about hinge line 36 over the stacks and tab section 23, 24, with tab section 38 now folded over folded tab section 26 and with fastener 40 latched to mating fastener 30, as shown in FIG. 4.

Stack A envelopes 44 are fastened by a set of fasteners 46 on central position 32, located nearer to hinge line 36 of cover 36 then to hinge line 44 joining cover 16 so as to provice space, in the closed position, for stack B envelopes 44 which are fastened by fasteners 46 to tab 26. The fasteners 46 holding stack B to tab 26 are similarly located nearer to the fold line 14 of cover 16. As shown in FIG. 4, the axis of location of the fasteners 46 of album A are located relatively near to cover 34 and relatively far from cover 16 in the closed position of the album, with the fasteners 46 of album B being located relatively near to cover 12 and relatively far from the opposed cover 34.

While the envelopes of stack A and B are in relatively upside-down relation to each other in the closed position, the open end of each set of envelopes 44 point towards the case and sections 26 and 32 to prevent slippage of the contents of the envelopes regardless of the orientation of the closed album.

However, in the open position of the album, all the envelopes of both stacks may be oriented so as to open upwards, in the vertical position, or lie in horizontal planes.

The fasteners used herein may be mating snap fasteners 30, 40 or Velcro type bands where light articles are to be accommodated in case 10. Other appropriate fastening means may be employed.

Figure 6:
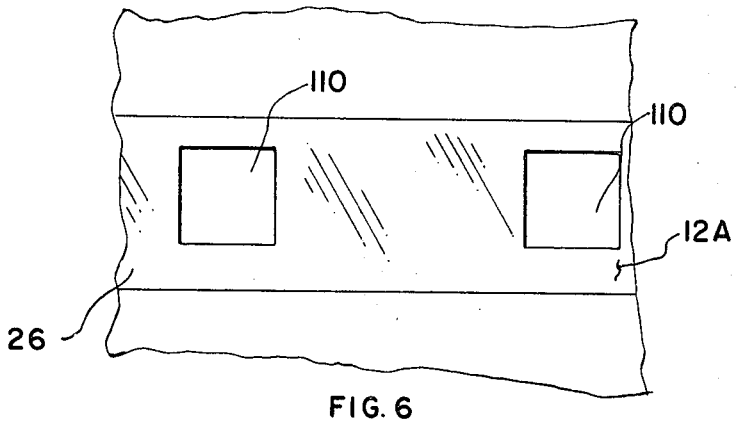
FIG. 6 is a bottom detail view of an alternative embodiment of a side panel.
Figure 7:
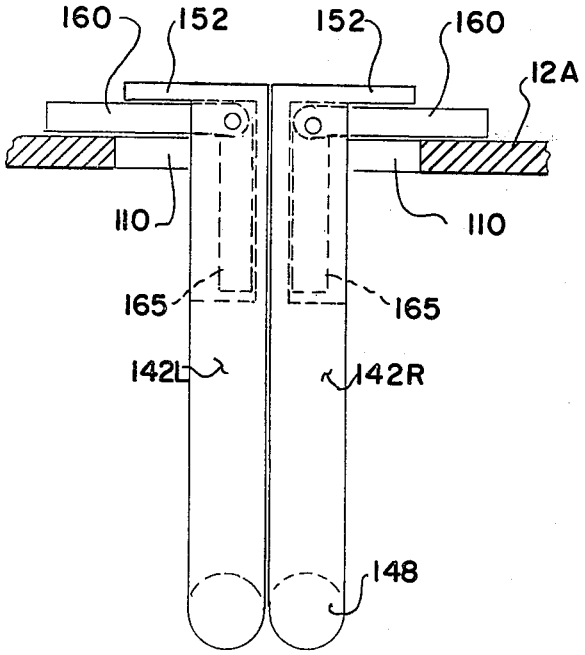
FIG. 7 is a section view of an alternative embodiment of a detachable handle mounted in the side panel.
Figure 8:
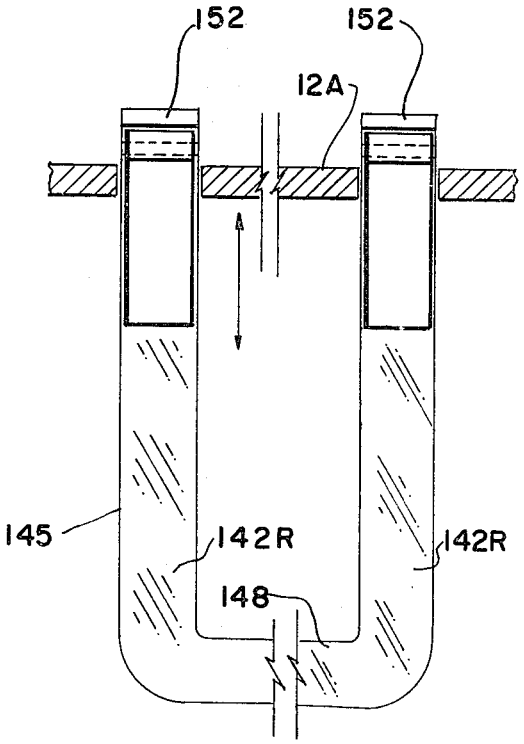
FIG. 8 is a section view of the handle about to be removed into or out of the panel.

FIGS. 6–8 illustrate an alternative embodiment of a detachable handle unit 142 mounted through square holes 110 in a panel 12A which takes the place of panel 12 of the case 10.

Handle 142 is preferably formed of two units 142R and 142L, each of which is formed of a pair of vertical spaced leg sections 145 joined to a grip member 148.

The free end of each leg section 145 is of a size to freely fit through a hole 110 when two units 142R and 142L are held adjacent each other. A fixed detent 152 extends transversely from the end of each leg section 145 and is of a size to permit the leg section 145 to freely pass through a hole 110.

A pivoted stop member 160 is mounted by a pin 162 to each leg section 142L, 142R and fits inside of a recess 165 in respective the leg section. With the end of each leg unit inserted through a hole 110, each stop member may be rotated about pin 162 to extend laterally away from the leg member inside of the album. Detent 152 prevents each stop member from rotating beyond a right angle in the extended mode of the stop member so that each handle leg is latched in place inside the album panel 12A. The handle 142 may be readily removed from the album by folding the stop members into their respective recesses, and withdrawing the leg members from the panel. The handle 142 may be shaped so that detent 152 and stop member 160 extend in the longitudinal axis of the handle, or alternatively trnsversely to the longitudinal axis.

The device of the invention has been thoroughly tested under actual use conditions and has been found to be completely successful for the accomplishment of the above-stated objects of the present invention.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A carrier album case comprising:
- a plurality of case members;
- hinge members;
- connecting said members for movement between an open position wherein said case members lie in generally coplanar relationship and a closed position with at least some of said case members folded on adjoining case members to form said case;
- releasable fastening means fixed on said adjoining case members to secure same in said closed position;
- a pair of stacks of envelopes secured at their middle to spaced apart case members and forming article-receiving holders at each end;
- said stacks coming into contact in upside-down relationship when said case is closed.

2. The case of claim 1 having handle means on the outside of at least one of said case members.

3. The case of claims 1 or 2, wherein said case members consist of semi-rigid material.

4. The case of claim 1, wherein said hinge means consist of fold lines secured in said case members.

5. The case of claim 1 wherein said case members are shaped from a generally flat rectangular, having:
- a bottom section with foldable, upper, lower and end tabs integral therewith;
- score lines separating tabs from said bottom section;
- said tabs having foldable end flanges;
- fasteners on the inside of said flanges;
- a cover member;
- a central portion foldably connected to said cover and to said bottom section;
- said cover member terminating in a closing tab having complementary fasteners adapted to engage said fasteners on the end flange of said end tab;
- a stack of double ended envelopes secured to said central portion; and
- a stack of similar envelopes secured to the inside of said end tab of said bottom section.

6. The case of claim 5, having a handle secured to the outside of said end tab of said bottom section.

7. The case of claim 1 or 6 wherein said stacks are releasably secured.

8. The case of claim 1 wherein said envelopes are adapted to contain phonograph records.

9. The case of claim 2 in which the handle is fitted with means to detachably engage the associated case member.

* * * * *